United States Patent [19]

Hasegawa et al.

[11] Patent Number: 4,499,935

[45] Date of Patent: Feb. 19, 1985

[54] VENEER LATHE

[75] Inventors: Katsuji Hasegawa, Nagoya; Yasuhiro Ibuki, Ohbu, both of Japan

[73] Assignee: Meinan Machinery Works, Inc., Japan

[21] Appl. No.: 451,749

[22] Filed: Dec. 21, 1982

[30] Foreign Application Priority Data

Dec. 28, 1981 [JP] Japan ..... 56-211649

[51] Int. Cl.[3] ..... B27L 5/02

[52] U.S. Cl. ..... 144/209 R; 144/209 A; 144/213

[58] Field of Search ..... 144/209 R, 209 A, 213, 144/213 A, 214, 215, 365; 29/26 A, 564.2; 82/40

[56] References Cited

U.S. PATENT DOCUMENTS 3,152,626 10/1964 Nicholson ..... 144/209 R
4,141,397 2/1979 Schmidt ..... 144/209 R
4,269,243 5/1981 Hasegawa ..... 144/209 R
4,356,850 11/1982 Halgrimson et al. ..... 144/209 R
4,413,540 11/1983 Burge ..... 144/209 R

*Primary Examiner*—Francis S. Husar
*Assistant Examiner*—Jorji M. Griffin

[57] ABSTRACT

A veneer lathe for turning a log thereon to cut off veneer sheets therefrom. The log is principally driven by a rotary roller having a plurality of projections therearound, which roller is pressed against the log to ensure positive engagement with the periphery thereof. The log is formed with a center bore at a core portion thereof. A spindle to support the log is inserted into the center bore to prevent the log deflection due to the pressure from the rotary roller. Another form of this veneer lathe is additionally provided with a center bore forming mechanism together with a centering mechanism for the boring operation such that a center bore is formed in the log in advance before being turned on the veneer lathe.

5 Claims, 23 Drawing Figures

VENEER LATHE

BACKGROUND OF THE INVENTION

The present invention relates to the improvement of a veneer lathe to cut off veneer sheets from a log.

In a conventional veneer lathe, a driving force is transmitted to the butt ends of a log through the chucks of a spindle which grips the butt ends of the log directly. In such a veneer lathe, since the diameter of the chuck is smaller than the diameter of the log, the gripped butt ends of the log can not withstand the cutting resistance applied to the log by the cutting knife, so that the gripped butt ends are twisted off or fractured frequently. Thus such a conventional veneer lathe has a disadvantage that most logs cannot be cut down to an intended diameter (usually 100 mm for a log of 1 m in length).

The applicant of the present invention developed and proposed a new veneer lathe such as disclosed in Japanese Patent Publication No. 56-16729 in order to overcome the disadvantage of the conventional veneer lathes. The new veneer lathe proposed by the applicant of the present invention, comprises a rotary roller having a plurality of annular driving members each having a plurality of spikes arranged along the circumference thereof, said driving members being attached to the roller at suitable intervals along the axial direction of the rotary roller, said rotary roller being disposed substantially in parallel to an edge of the cutting tool and so as to enable the spikes to thrust into the circumference of a log at a position near the edge of the cutting knife, a driving unit for driving the rotary roller and a pressure member, such as a fixed bar or a roller, disposed on at least one side of each driving member, to wit, in some of a plurality of spaces formed between the driving members of the rotary roller.

Since driving force is applied to a log at the circumference thereof near the edge of the cutting knife through the driving members of the rotary roller in cutting the log on the above-mentioned new veneer lathe, damage to the log resulting from the concentration of stress on the gripped part of the log, which is likely to occur in cutting a log on a conventional veneer lathe, occurs scarcely. Additionally, a trouble that a space between the pressure members and a log is clogged with foreign matters such as the bark of logs and pieces of wood and damage to logs resulting from such a trouble are avoided and almost all logs can be cut down to a conventionally intended diameter to produce superior veneer sheets, so that many logs are cut into veneer sheets remarkably effectively as compared with log cutting on conventional veneer lathes.

The outside diameter of a stripped core of about 100 mm for a log of 1 m in length was a desirable outside diameter at the times when logs of comparatively large diameters were available comparatively easily. However, such an outside diameter is not necessarily said to be sufficiently reduced in recent years, when logs of large diameters are not easily available, much less in the future when the diameter of available logs will be reduced still further and hence a further reduction of the outside diameter of the stripped core will be necessary.

As well known, the rigidity of wood in general is considerably low as compared with those of metals and the deflection of a cylindrical body varies in proportion to a function of the fourth power of the diameter and the third power of the length. Therefore, when the outside diameter of the stripped core is reduced below 100 mm, the rigidity is reduced sharply with the result that the log is broken or that a veneer sheet of uneven thickness unsuitable for use is produced due to considerably increased deflection of the log. Furthermore, the spikes of the driving member are required to be thrusted deeper into the circumference of a log to prevent the sharp reduction of the engagement between the circumference of the log and the driving members of the rotary roller as the diameter of logs becomes smaller. The presence of cracks caused by stress and radiating from the core (the heart of the log) also promote damage to logs. Accordingly, even the above-mentioned new veneer lathe is incapable of cutting a log easily to a smaller diameter merely by reducing the outside diameter of the spindles and thereby is incapable of coping with expected difficult availability of suitable logs.

SUMMARY OF THE INVENTION

The present invention improves the above-mentioned new veneer lathe further to enable the veneer lathe to cut a log down to a still smaller diameter and provides a veneer lathe capable of effectively cutting logs under the present condition of log supply and of capable of coping with the future log supply condition, in which only logs of reduced diameters will be available.

DETAILED DESCRIPTION OF THE EMBODIMENTS

A veneer lathe according to the first embodiment of the present invention is provided for cutting logs each having a center bore or bores formed beforehand in the log along the center axis thereof at an appropriate place and is constituted so as to support a log with spindles inserted in the center bore, while a veneer lathe according to the second embodiment of the present invention is designed so as to drill a center bore or bores along the center axis of a log and at the same time to support the log with spindles inserted into the center bore or center bores. Thus, each veneer lathe of the present invention securely supports a log through the engagement of spindles with the center bore or the center bores formed in a log. The detailed forms of spindles will be described more concretely hereinafter.

Figure 3:
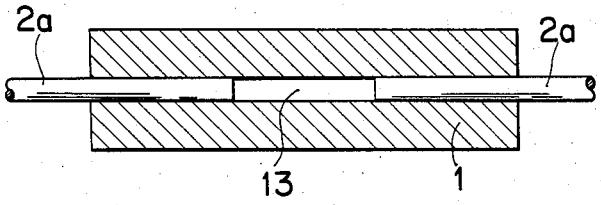
FIGS. 3 to 10 are schematic illustrations of a log and spindles for explaining various manners of engagement between the center bores formed in a log and spindles.
Figure 4:
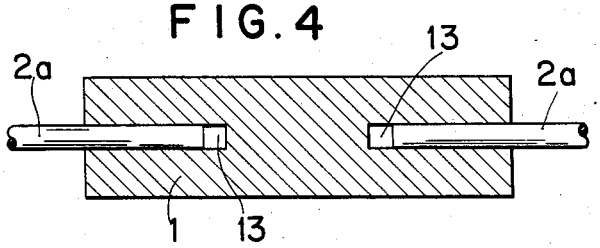
Figure 5:
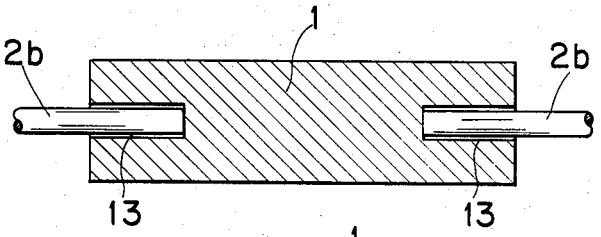
Figure 6:
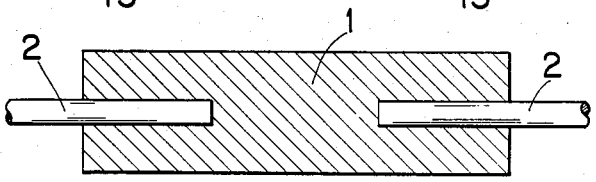
Figure 8:
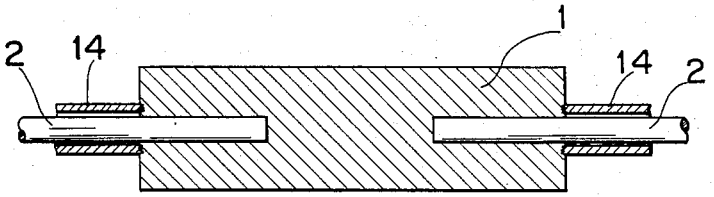
Figure 9:
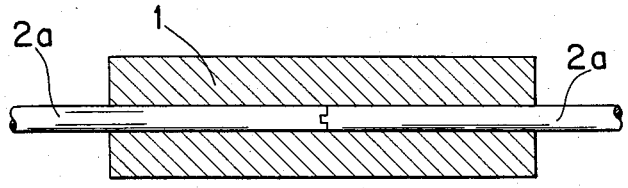

Various forms of engagement between the spindles and the center bore or the center bores of a log are possible, which are, for example, inserting spindles 2*a* each having a diameter that fits the corresponding center bore 13 drilled through a log along the center axis thereof into the center bore 13 as shown in FIGS. 3 and 9, inserting spindles 2*a* each having a diameter that fits the corresponding bottomed center bore 13 formed in a log along the center axis thereof into the center bores 13 as shown in FIG. 4, inserting spindles 2*b* each having a length reaching the bottom surface of the corresponding bottomed center bore 13 formed in a log along the center axis thereof into the bottomed center bores 13 as shown in FIG. 5 and inserting spindles 2 each having a diameter that fits the corresponding bottomed center bore formed in a log 1 along the center axis thereof and a length reaching the bottom surface of the same bottomed center bore into the bottomed center bores as shown in FIGS. 6 and 8. In either case, the appropriate and sure support of a log is attained by the use of spindles each formed in a diameter and/or length that fits the center bore formed in the log, which supporting manners constitute the principle of the present invention.

Figure 1:
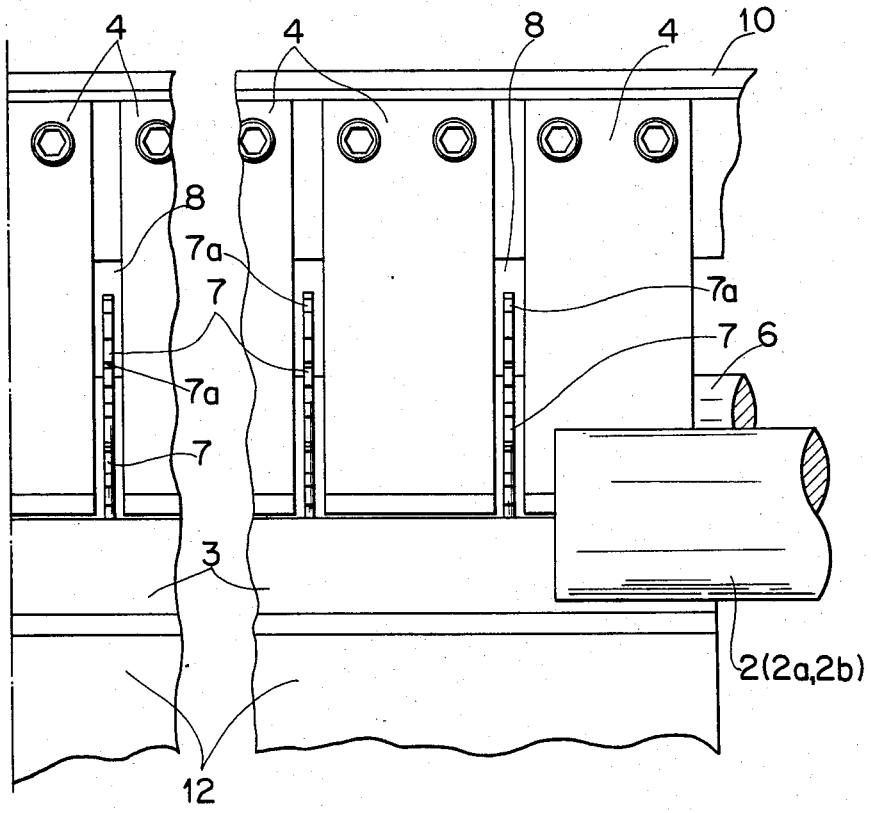
FIG. 1 is a partial elevation of one embodiment of the present invention.
Figure 2:
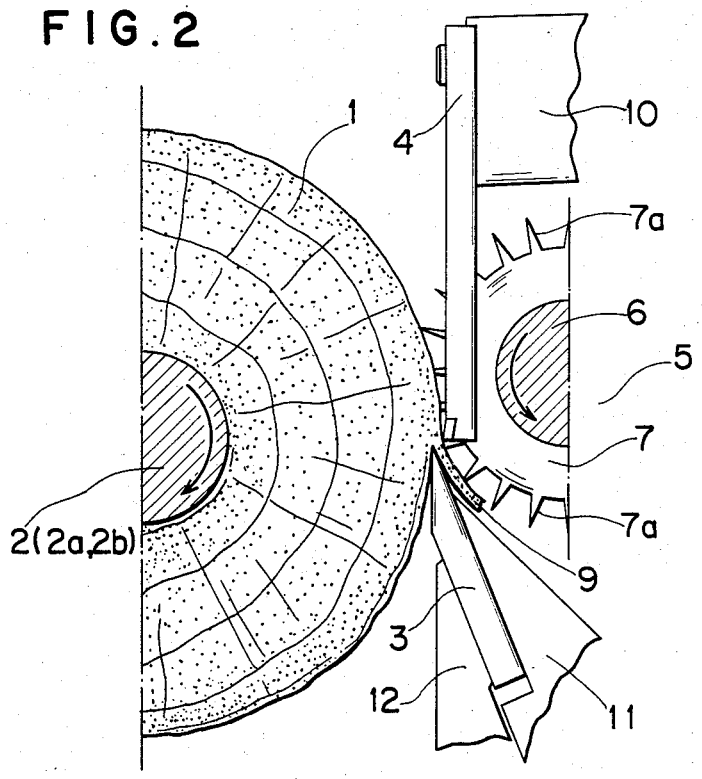
FIG. 2 is a side elevation of the veneer lathe of FIG. 1.

FIG. 1 is a partial elevation of one embodiment of the present invention. FIG. 2 is a side elevation, of the veneer lathe of FIG. 1, showing actual log cutting operation by way of example. In FIGS. 1 and 2, a cutting tool indicated at 3 is fastened with a tool holder 12 to a tool support 11 which is adapted to move toward the center axis of a log 1 supported by spindles 2 (2*a*, 2*b*) inserted into the center bore of the log 1 as the log 1 is turned, for cutting off a veneer sheet 9 from the log 1 and away therefrom. Divided fixed bars 4 are fastened to a pressure bar holder 10 which moves together with the knife support 11. Said divided fixed bars 4 are disposed between spaces 8 formed between annular driving members 7 of a rotary roller 5 which will be described hereinafter and so as to press the boundary between the log 1 and the veneer sheet 9. The rotary roller 5 is formed by attaching a plurality of annular driving members 7 thereto each having a plurality of spikes 7*a* arranged along the circumference thereof on a shaft 6 at suitable axial intervals to form the spaces 8 for receiving pressure members such as the fixed bars 4 therein. The rotary roller 5 is supported in bearings 17 fixedly mounted on the pressure bar holder 10 practically in parallel to the edge of the cutting knife 3 and so as to enable the spikes 7*a* to thrust into the circumference of a log at a position near the edge of the cutting tool 3 during the cutting operation and is driven by a driving source such as a motor, not shown, through a sprocket wheel 18 or the like in order to drive the log along the circumference thereof near the edge of the cutting knife 3.

The veneer lathe according to the first embodiment of the present invention is constituted as described hereinbefore. In operation, when a log having center bores formed therein beforehand along the center axis thereof is fed to the veneer lathe, spindles are inserted into the center bores to support the log, and then the log is cut successively into veneer sheets of a desired thickness through the movement of the cutting tool toward the log and the driving of the log with the rotary roller. Since the line of action of the resistance of the cutting knife and the pressure members is close to the line of action of the counteracting driving force, those opposite forces are well counterbalanced. Therefore, the damage of the log attributable to the concentration of stress is prevented. In addition, since part of or all of the stress-induced cracks which have been present in the heart of the log are removed as a result of drilling the center bores, the damage of the log attributable to those cracks is prevented or is remarkably reduced. Furthermore, since the log is supported with spindles inserted into the center bores formed in the log, the deflection of the log is reduced as compared with the deflection of logs on conventional veneer lathes. Consequently, the breakage of the log or the irregularity in thickness between veneer sheets is avoided and the spikes can thrust into the circumference of the log due to the increased rigidity of the log to drive the log surely. Accordingly, the log can be cut to a small diameter to such an extent that has been impossible on conventional veneer lathes and veneer sheets of good quality can be produced.

Incidentally, in an experimental cutting operation, a larch log of approximately 1 m in length having center bores of 5 cm in diameter and 20 cm in depth formed in the opposite butt ends was subjected to cutting on a veneer lathe provided with spindles of 5 cm in diameter on the opposite ends thereof by supporting the log as shown in FIG. 6. The log could be cut to approximately 6 cm in diameter and good veneer sheets of a desired thickness were obtained.

When a log fed to the veneer lathe of the present invention is barked and dressed practically in a regular cylindrical shape, the log may be driven at the start of cutting only by the rotary roller with the result that the driving mechanism for driving the spindles can be omitted. Usually, however, logs have irregular external shapes and hence it is extremely difficult to drive a log only by the rotary roller in cutting the log. Therefore, it is desirable to provide a driving mechanism, such as a motor, for idling the log in preparation for the advancing tool. Naturally, the log may be driven directly by means of the spindles. However, since the principal driving means is the rotary roller anyhow, it is desirable to harmonize the rotary roller and the spindles by turning the rotary roller at a speed higher than that of the spindles or if necessary, by interposing a buffing mechanism, such as a one-way clutch, between the rotary roller and the driving unit or by interposing a buffing mechanism, such as a torque limiter, between the spindles and the driving unit.

Figure 7:
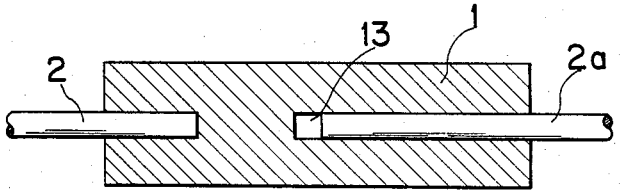
Figure 10:
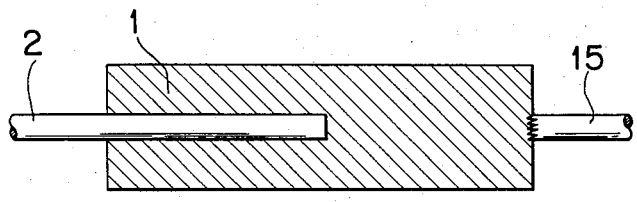

It is effective to attain stable support of a log to insert both right-hand and left-hand spindles into the corresponding center bores, for example, as shown in FIGS. 3 to 9. However, the forms of the right-hand and left-hand spindles are not necessarily the same with each other as shown in FIG. 7. Although not necessarily desirable, either the right-hand or the left-hand spindle may be a conventional spindle 15 which is not inserted into the center bore as shown in FIG. 10. Furthermore, if necessary, a known double spindle mechanism as shown in FIG. 8 may be employed, in which a larger spindle 14 is provided over the spindle 2 (2*a*, 2*b*) to support a log and the log may be driven also by means of the larger spindle until a suitable timing.

Figure 14:
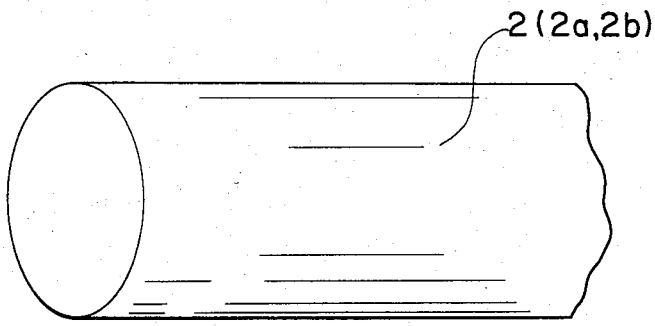
FIGS. 14 to 17 are partial perspective views of various forms of spindles according to the present invention.
Figure 15:
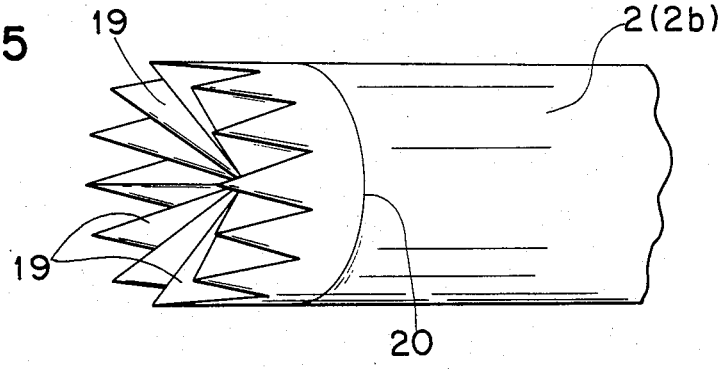
Figure 16:
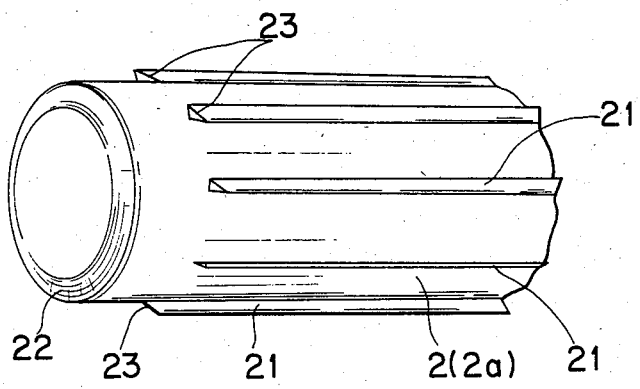
Figure 17:
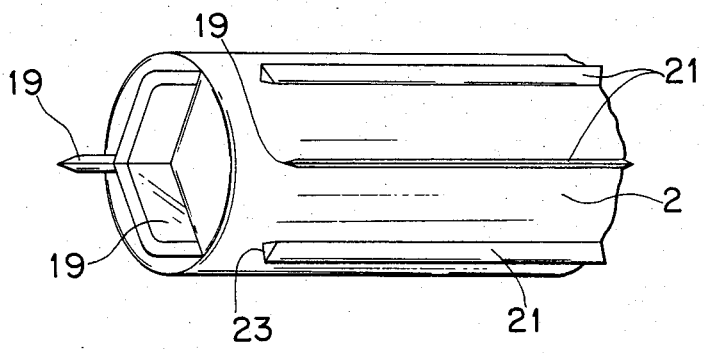

The form of the spindle inserted into the center bore formed in a log is basically a cylindrical shape as shown in FIG. 14. However, the form is not limited to a regular cylinder of a uniform diameter but may be a cylinder having a plurality of sharp projections 19 of a suitable shape at the extremity thereof as shown in FIG. 15, a cylinder having a plurality of projections 21 of a suitable shape along the circumference thereof as shown in FIG. 16 or a cylinder having a plurality of sharp projections 19 of a suitable shape at the extremity thereof and a plurality of projections 21 of a suitable shape along the circumference thereof as shown in FIG. 17. Such spindles of modified forms prevent effectively the slip between the spindle and the log and ensure further the engagement between the spindle and the log, so that the spindles are capable of effectively driving the log as occasion demands.

Naturally, the right-hand spindle and the left-hand spindle may be joined within the center bore, as shown in FIG. 9, if necessary. The detachable front end portion extending from the front end to a suitable position indicated at 20 in FIG. 15, will facilitate the replacement of the projections when worn out and will allow the diameter of the spindle to be changed. Similarly, detachable projections will facilitate the replacement of the projections when worn out. Provision of a guide member 22 having a suitably chamfered head will facilitate the insertion of the spindle into the center bore. Provision of a cutting edge 23 for the edge of the projections 21 will prevent the damage of the log resulting from pressure-fitting the projections into the log and will allow smooth insertion of the spindle into the center bore. In either case, the respective forms of those projections are not limited to those as shown in the drawings. The diameter of the spindles includes an error permitting the elastic and plastic deformations of the fibers of wood including the error and the strains in the center bores. When projections are provided along the circumference of the spindle, a further increased range of tolerance on the error is allowed owing to the pressing action of the projections.

Figure 12:
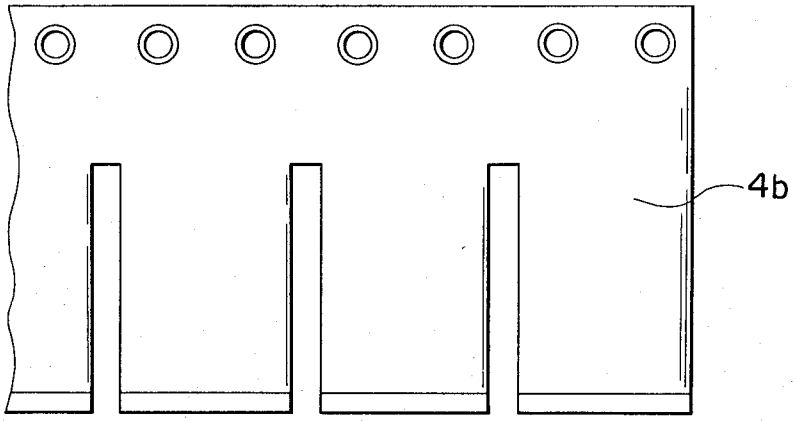
FIG. 12 is a partial elevation of a fixed bar provided on the veneer lathe.
Figure 11:
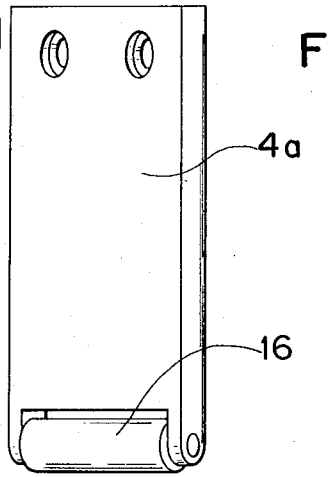
FIG. 11 is a perspective view of a roller bar provided on the veneer lathe.

The pressure members are not limited to those fixed bars as shown in FIGS. 1 and 2, but may be roller bars each formed of a divided holder 4*a* and a roller 16 supported rotatably by the divided holder 4*a*, as shown in FIG. 11, or may be an undivided fixed bar 4*b* formed in the shape of a comb as shown in FIG. 12. In either case, smooth removal of foreign matters, such as bark of logs and wood pieces, and absorption of the local hardness variation in logs are possible when the pressure members are fastened to the pressure bar holder in the manner of cantilever as illustrated so as to allow the elastic deformation of the pressure members, consequently, satisfactory cutting operation can be attained effectively.

Figure 13:
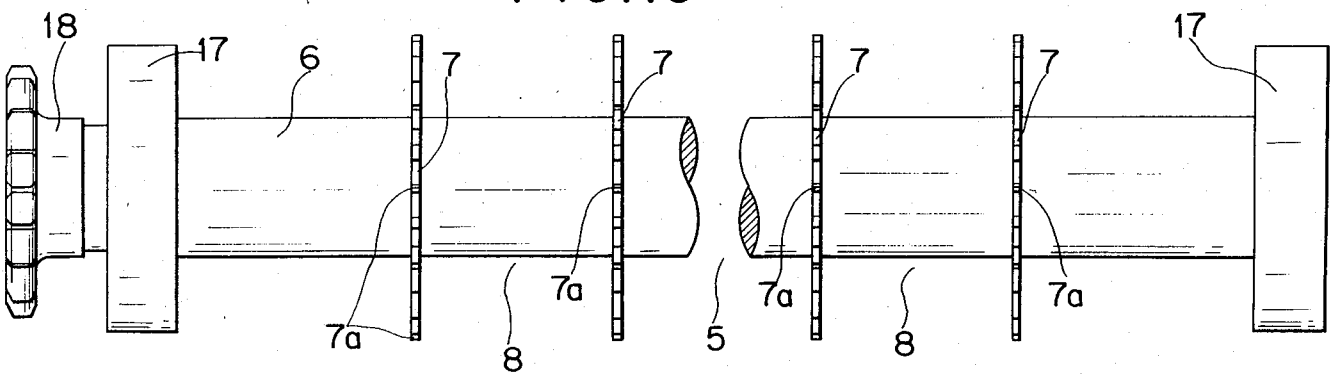
FIG. 13 is a partial elevation of a preferred example of the rotary roller.

The form of the driving member of the rotary roller is not limited to the form of a circular saw as illustrated and the form of the spike, in particular may be a wedge-shape as illustrated or various other shapes such as a needle-shape, a conical shape and a pyramidal shape. In either case, a shape that allows the spike to thrust into a log easily is suitable for effectively driving a log. Instead of forming the driving members integrally with the shaft as shown in FIG. 13, the driving members may be mounted detachably on the shaft, which facilitates forming the rotary roller and replacing the driving members in case of wear and reduces the manufacturing cost and the cost of wear and tear.

The rotary roller may be disposed so as to allow the spikes to thrust only into the circumference of a log at a position near the edge of the cutting knife or so as to allow the spikes to thrust into the circumference of a log at a position near the edge of the cutting knife and also to thrust into the veneer sheet at a position immediately after the edge of the cutting knife. Furthermore, a stripping member, not shown, of a suitable shape for surely separating the veneer sheet and foreign matters from the spikes may be provided, if necessary, in a space after the driving members.

The center bores drilled in a log will be described hereinafter. The position of the center bores in a log may be determined by a suitable method selected from various methods, such as a method of aligning the center axis of the bore with the center axis of the imaginary inscribed cylinder of a log for attaining the best yield of a continuous veneer sheet as the principal object, a method of aligning the center axis of the bore with the center axis of the imaginary circumscribed cylinder of a log for attaining the best yield rate as the principal object, a method of aligning the center axis of the bore with the center axis of the heart of a log for allowing the general classification of veneer sheets by water content as the principal object, and a method of determining the position of the bore specially to clear off the deteriorated portion, such as the rotten portion, of a log. The depth of the center bore may be comparatively small when the length of the spindle is as long as to reach the bottom of the center bore, whereas a comparatively large depth is effective when a spindle having a diameter capable of engaging with the inside surface of the bore is inserted into the center bore. Naturally, the bores may be a single through bore penetrating through a log or the form may be different between the right-hand center bore and the left-hand center bore. In either case, it is desirable that the depth of the center bores is equivalent to or greater than the diameter of the spindle. Chamfering the edge of the center bores will facilitate insertion of the spindle into the bores.

Storage of logs to be cut after drilling such center bores in the logs will effectively prevent or reduce the occurence or development of cracks caused by stress or contraction resulting from drying. On the other hand, however, such a method of storage has disadvantages that the center bores and the spindles have to be center-aligned again in feeding the drilled log to the veneer lathe, which is inefficient if the bores and the spindles are center-aligned mechanically or manually and that drilling the logs manually by means of a boring machine equipped with a drilling tool such as a wood drill is not only inefficient but also causes troubles such as misalignment or misdrilling, so that regular cutting is impossible due to inappropriate insertion of the spindles in the center bores. Thus such a method of storage of logs is not preferable.

A veneer lathe according to the second embodiment of the present invention comprises, in addition to the veneer lathe of the first embodiment, a boring mechanism for drilling center bores in a log along the center axis thereof and a log feeding mechanism for feeding a log having center bores to the main part of the veneer lathe, and is capable of extremely efficiently cutting a log. A veneer lathe according to the second embodiment will be described hereinafter.

Figure 18:
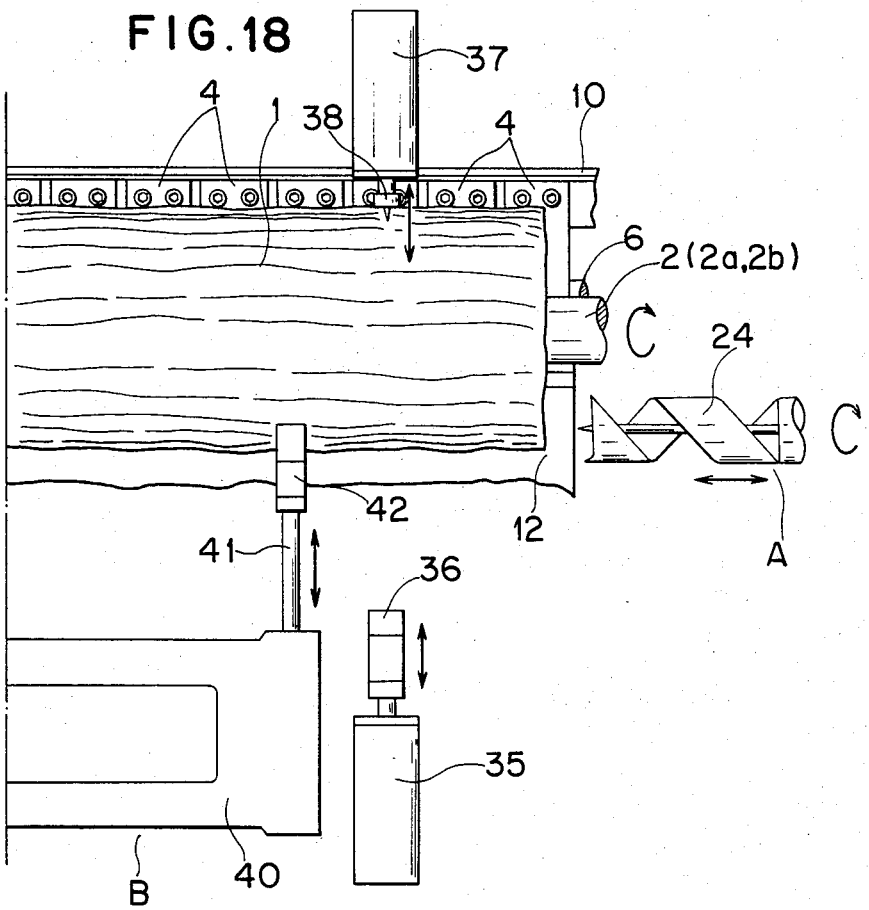
FIG. 18 is a partial elevation of another embodiment of the present invention.
Figure 19:
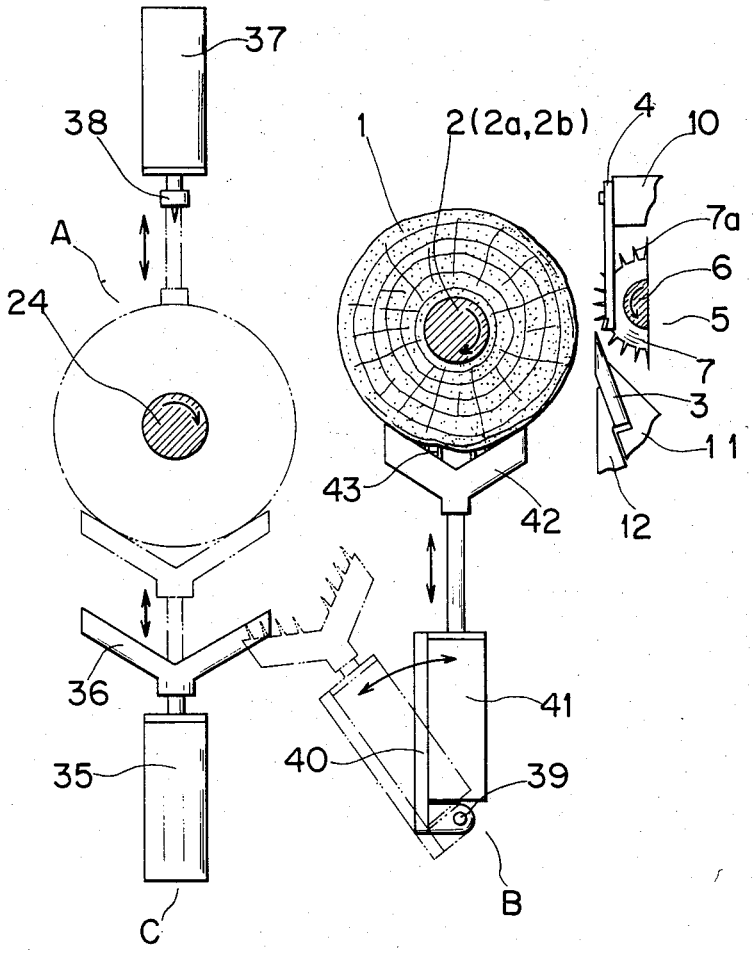
FIG. 19 is a side elevation of the veneer lathe of FIG. 18.
Figure 20:
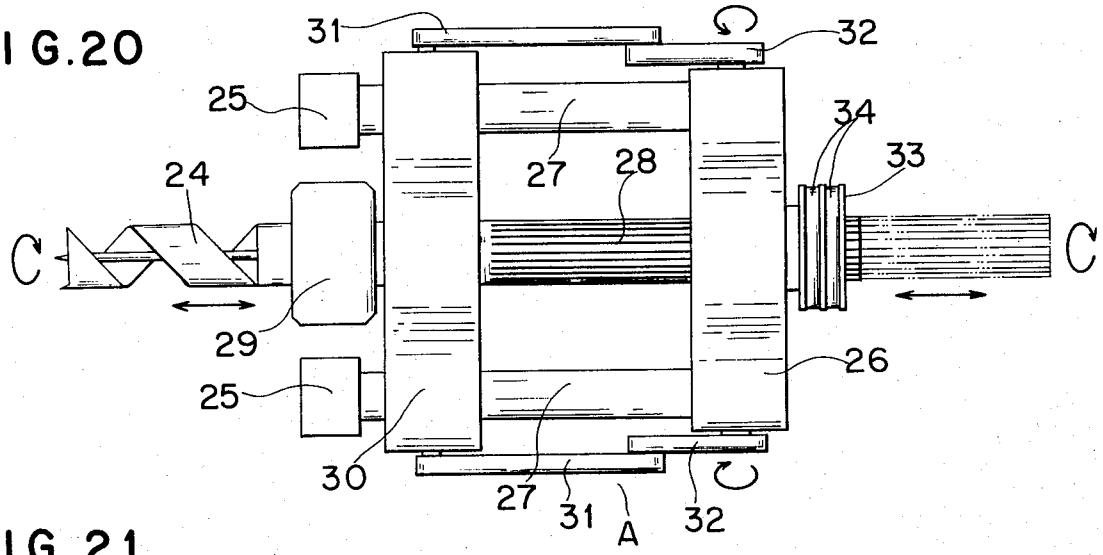
FIG. 20 is a partial plan view of a boring mechanism used in the embodiment of FIGS. 18 and 19.
Figure 21:
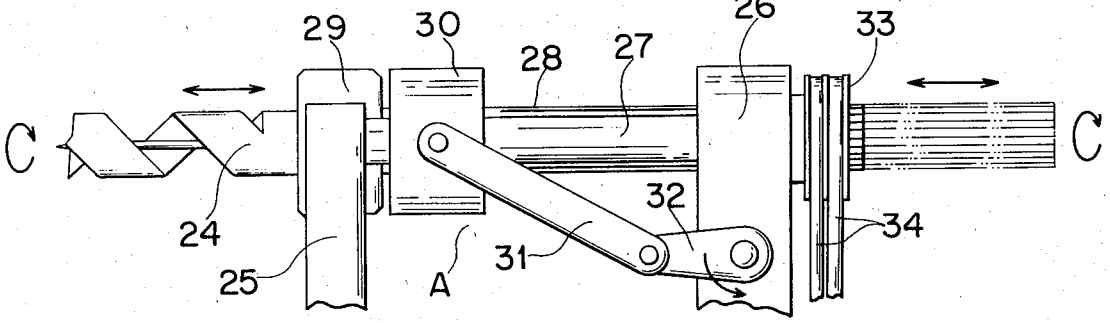
FIG. 21 is a side elevation of the boring mechanism of FIG. 20.

FIG. 18 is a partial elevation of the second embodiment. FIG. 19 is a side elevation of the veneer lathe of FIG. 18. A boring mechanism is indicated generally at A. As shown in FIGS. 20 and 21 by way of example, the boring mechanism A is provided retractably with a wood drill 24 held by a drill chuck 29 attached to the front end of a splined shaft 28 rotatably supported by a slide base 30 driven to reciprocate along slide guides 27 supported by metals 25 and 26 by means of a suitable driving device, not shown, through levers 31 and 32 and adapted to be driven for rotation by a suitable driving device, not shown, through a pulley 33 and a belt 34, is provided, on each of the right-hand side and the left-hand side thereof, with a centering device C including lifting devices 35 and 37 each having a hydraulic cylinder, a log support 36 adapted to be raised and lowered by the lifting device 35 and a log holder 38 adapted to be raised and lowered corresponding to the upward and downward movement of the log support 36. The boring mechanism A drills a center bore along the center axis of a log 1 supported and centered by the centering devices C, which is constituted so as to determine the center axis on the basis of the external form of the log 1. A log feeding device B comprises a swing base 40 adapted to be driven by a driving device, not shown, including a crank mechanism and hydraulic cylinders so as to swing on a shaft 39 and a pair of spiked bases 26 disposed on the right-hand side and the left-hand side, respectively, of the log feeding device, provided with a plurality of spikes 43 on the surfaces thereof for receiving a log and adapted to be raised and lowered and also to be fixed at an appropriate position by means of an operating device 41 having a locking mechanism including hydraulic cylinders having intermediate position locking mechanisms and connected to the right-hand side and the left-hand side of the swing base 40. The log feeding device B transports a log 1 which has been drilled by the boring mechanism A to form center bores along the center axis thereof to the main part of the veneer lathe by holding the log 1 with the spiked bases with the spikes thrusting into the log 1. The constitution of the main part of the veneer lathe of the second embodiment is identical with the veneer lathe of the first embodiment.

The exemplary veneer lathe of the second embodiment as described hereinbefore operates in the following manner. When supplied to the veneer lathe, the log 1 is centered by the centering devices C, then center bores are formed along the center axis of the log 1 by means of the boring mechanism A, then the log 1 is transported to the main part of the veneer lathe by means of the log feeding device B and is supported by the spindles 2 (*2a, 2b*), and then the log is cut gradually.

As apparent from what has been described hereinbefore, the veneer lathe of the second embodiment comprises, in addition to the veneer lathe of the first embodiment, a boring mechanism for drilling center bores in a log along the center axis thereof and a log feeding device for transporting the log having center bores drilled therein to the main part of the veneer lathe. Accordingly, the veneer lathe of the second embodiment is not only capable of cutting a log to a reduced diameter as compared with diameters attainable by conventional veneer lathes, but also is capable of effectively eliminating troubles such as misalignment or misdrilling, which troubles are liable to occur when the center bores are drilled in a log manually by means of a drilling apparatus, of preventing various disadvantages such as the damage of the log and the irregular diameter of the veneer sheet which are caused by the deflection of the spindles or bending of the spindles which is attributable to above-mentioned troubles, of effectively performing appropriate cutting of the log and of remarkably efficiently carrying out the cutting operation as compared with cutting a log by taking out each time a log which has been stored after forming center bores along the center axis thereof and by supporting the log after centering the log again.

The boring mechanism is shown in the drawings only by way of example and hence is not limited thereto. The boring mechanism may be a boring apparatus equipped with a built-in driving source, such as an electric drill or a pneumatic drill, disposed retractably and provided with a drilling tool such as a woodworking drill. Essentially, the boring mechanism may be of any form provided that it is provided retractably with a drilling tool such as a wood drill and is capable of drilling a center bore along the center axis of a log supported by the centering device or the log feeding mechanism. The provision of the boring mechanisms on both ends of the veneer lathe or the provision of the boring mechanism either on the right-hand side or the left-hand side of the veneer lathe may be suitably and selectively corresponding to the form of the spindle or spindles of the main part of the veneer lathe. Furthermore, when the spindle or the spindles of the main part of the veneer lathe is divided at an appropriate part thereof so as to make the front part replaceable and various front parts are used alternately, it is required only to make the distance of the axial movement and the thickness of the drilling tool changeable.

A woodworking drill is preferable for the drilling tool, since a woodworking drill has a high capability of removing chips, however, a metalworking drill may be used. Essentially, any drilling tool may be used provided that the drilling tool is capable of drilling a center bore of a desired form. Naturally, the point of a drilling tool need not necessarily be perpendicular to the center axis.

Figure 22:
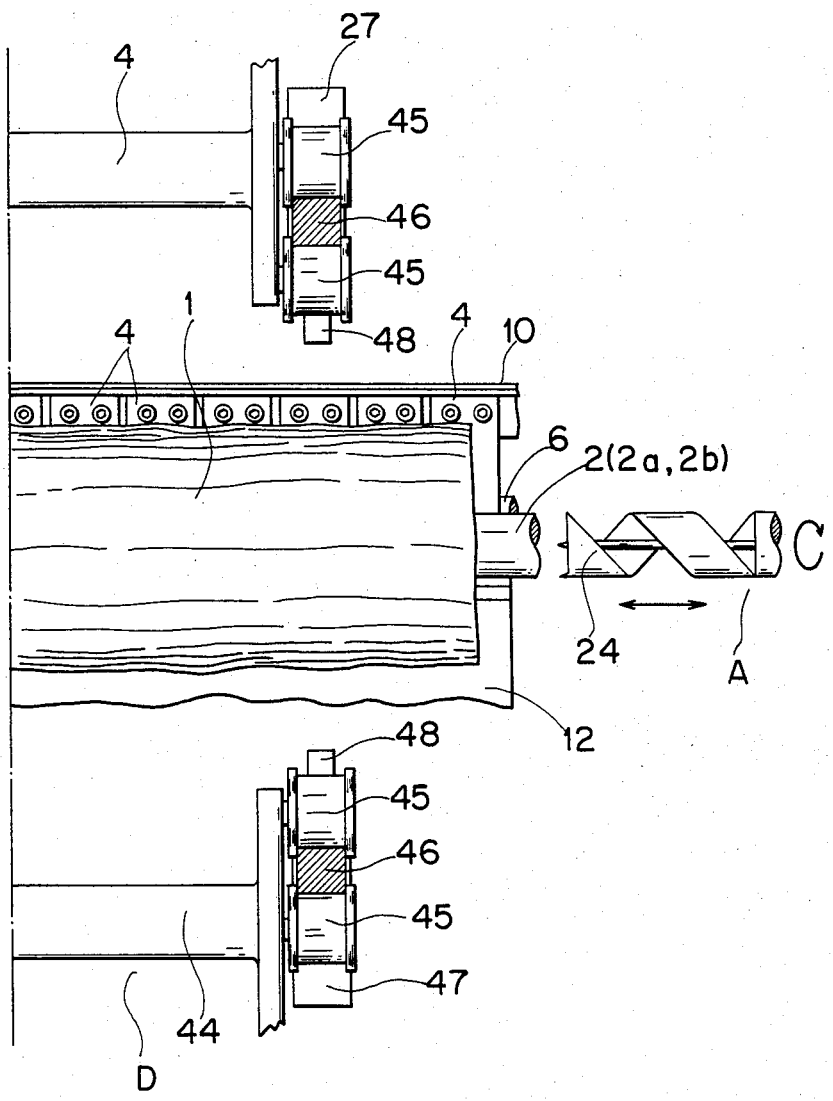
FIG. 22 is a partial elevation of a further embodiment of the present invention.
Figure 23:
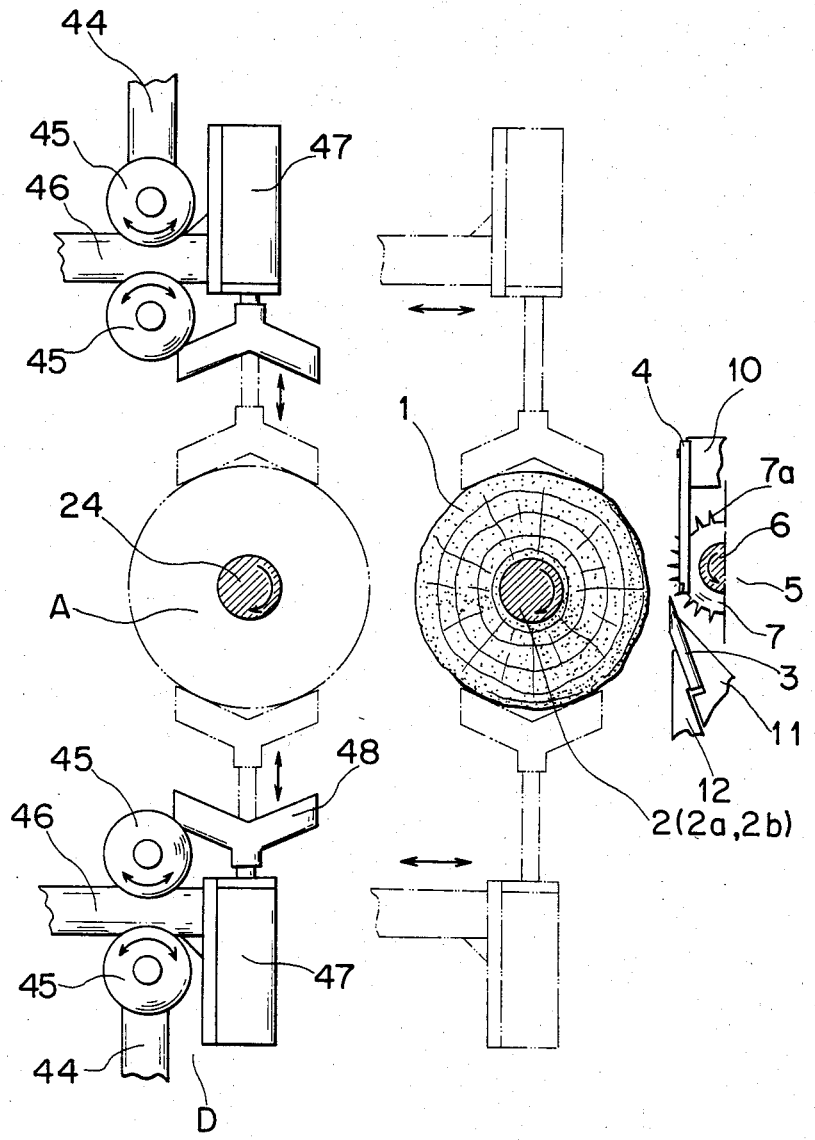
FIG. 23 is a side elevation of FIG. 22.

The log feeding mechanism is shown in FIGS. 19 and 20 by way of example and hence is not limited thereto. For example, the log feeding mechanism may be a log centering and feeding mechanism D as shown in FIGS. 22 and 23, comprising two sets of paired upper and lower slide arms 46 movably supported by rollers 45 rotatably supported by a frame 44 and adapted to be reciprocated between the boring mechanism A and the main part of the veneer lathe by a driving device, not shown, having a hydraulic cylinder, and paired upper and lower holding bases 48 adapted to be raised and lowered in harmony with each other by a lifting device 47 having hydraulic cylinders 47 attached to the respective front end of the slide arms 46. Each set of the upper and lower slide arms 46 and the upper and lower holding bases 48 is disposed on each side of the log centering and feeding mechanism D. The log centering and feeding mechanism D determines the center axis of a log on the basis of the external form thereof. The log feeding mechanism may be a mechanism including a pair of right and left spiked arms which thrust into the opposite butt ends of a log to hold the log and are adapted to reciprocate between the boring mechanism A and the main part of the veneer lathe. A log feeding mechanism of any form may be employed provided that the log feeding mechanism comprises spiked bases, holding bases or spiked arms adapted to hold a log having center bores and to be capable of reciprocating at least between the boring mechanism and the main part of the veneer lathe.

Furthermore, centering a log and drilling the center bores in the log need not necessarily be performed at the same position but may be performed at different positions. In case where centering a log and drilling the center bores in the log are performed at different positions, it is preferable to constitute the log feeding mechanism so as to make the log holding members travel from the centering position to the main part of the veneer lathe in three steps to avoid the additional provision of a means to transport a log from the centering position to the boring mechanism. Any known conventional centering device is applicable instead of the centering device as illustrated. In some cases, for example, in determining the center axis along the center axis of the heart of a log or in determining the center axis in a particular manner, it is more convenient to determine the center axis while holding a log by hand, therefore, a centering device need not necessarily be provided. Provision of a stripped core removing stopper of a suitable form, which allows the advancement and the retraction of the spindle and obstructs the advancement and the retraction of the stripped core of a log, near the either butt end of a log allows quick removal of the stripped core of a log after cutting merely through the retraction of the spindle. Such an arrangement further improves the cutting efficiency of the veneer lathe.

It will be apparent from what has been described hereinbefore that the veneer lathe according to the present invention is capable of cutting a log to a smaller diameter as compared with the conventional veneer lathe, extremely efficiently and is remarkably effectively applicable to plywood factories in view of the present state and the future prospects of the plywood industry that plywood factories are obliged to use the thin logs of South-Sea wood or to alternatively use small diameter logs due to the depletion of resources.

What is claimed is:

1. A veneer lathe for turning a log to cut off a veneer sheet therefrom comprising means for supporting and centering a log on said lathe, a boring mechanism having a retractable boring tool disposed on at least one side of a supported and centered log in facing relation to a butt end thereof operable to axially form a center bore in the log, means for feeding the log having the center bore therein to a predetermined position, spindle means at said predetermined position adapted to extend into the center bore axially formed in the log for rotatably supporting said log on the lathe at said predetermined position, a cutting tool adapted to move toward and away from said rotatably supported log, a rotary roller having a plurality of annular driving members each having a plurality of piercing members arranged thereround, said annular driving members being disposed around said roller at intervals along an axial direction of said rotary roller, said rotary roller being disposed substantially in parallel to an edge of the cutting tool and so as to enable said piercing members to thrust into the circumference of the log at a position near the edge of the cutting tool, a driving unit for driving said rotary roller, and a pressure member disposed on at least one side of each driving member to press the log slightly ahead of the tool edge.

2. A veneer lathe according to claim 1, characterized in that said centering and feeding means includes a centering device adjustably supporting the log relative to said retractable boring tool and a log feeding device swingably disposed between said boring device and said predetermined position.

3. A veneer lathe according to claim 1, characterized in that said centering and feeding means includes a log centering and feeding mechanism adapted to adjustably support the log relatively to said retractable boring tool and reciprocate between said retractable boring tool and said predetermined position.

4. A veneer lathe according to claim 1, characterized in that said spindle means includes a pair of spindles extending into the center bore from opposite butt ends of the log.

5. A veneer lathe according to claim 1, characterized in that said spindle means includes a first spindle extending into the center bore from one butt end and a second spindle gripping the log at the other butt end.

* * * * *